United States Patent [19]

Watanabe

[11] 4,270,557

[45] Jun. 2, 1981

[54] INCORRECTNESS DETECTING DEVICE FOR DETECTING COIN PILING CONDITION IN PILING CYLINDER OF COIN PACKAGING MACHINE

[75] Inventor: Kenkichi Watanabe, Tokyo, Japan

[73] Assignee: Laurel Bank Machine Co., Ltd., Tokyo, Japan

[21] Appl. No.: 58,307

[22] Filed: Jul. 17, 1979

[30] Foreign Application Priority Data

Jul. 18, 1978 [JP] Japan ..... 53/98659[U]

[51] Int. Cl.[3] ..... G07D 9/06

[52] U.S. Cl. ..... 133/8 D

[58] Field of Search ..... 133/8 R, 8 A, 8 D, 1 A, 133/8 E; 414/DIG. 901; 53/212

[56] References Cited

U.S. PATENT DOCUMENTS 4,040,434 8/1977 Watanabe ..... 133/1 A

*Primary Examiner*—Stanley H. Tollberg

*Attorney, Agent, or Firm*—Fleit & Jacobson

[57] ABSTRACT

Herein disclosed is an incorrectness detecting device for detecting the coin piling condition in a piling cylinder of a coin packaging machine. The detecting device includes a sensor which is made coactive with a coin kind selecting dial so that its height may be varied in accordance with the height corresponding to a preset number of coins piled. Further inclusive is a detecting element which is to be brought downwardly into contact with the upper side of the uppermost one of the piled coins, when the preset number of coins are piled in the piling cylinder, so that an electric circuit may be made through the piled coins. Further inclusive is a sensor element which is made coactive with the detecting element while corresponding to the sensor. As a result, the coil piling condition can be detected in response to both the signals, which are generated by the interaction between the sensor and its element, and the signals which are generated by the electric circuit made through the coins.

3 Claims, 3 Drawing Figures

INCORRECTNESS DETECTING DEVICE FOR DETECTING COIN PILING CONDITION IN PILING CYLINDER OF COIN PACKAGING MACHINE

BACKGROUND OF THE INVENTION

1. Field of the Invention

The present invention relates to a coin packaging machine, and more particularly to an incorrectness detecting device for detecting the piling condition of coins such as the excessiveness or shortage of the coins in a piling cylinder in accordance with the consistency or inconsistency between the signal of a sensor, which is made coactive with a coin kind selecting dial only when a preset number of coins are piled, after they have been counted, in the piling cylinder under a correct piling condition, and the signal, which is generated through the piled coins, so that the subsequent take-up operation of the piled coins may be accomplished from the piling cylinder.

2. Description of the Prior Art

According to the prior art, the incorrectness detecting device of such kind has its piling cylinder formed with a diametrical hole, along which a photoelectric device is moved up and down in accordance with the kind of coins or into and out of which an inspecting lever is moved sideway. As a result, the correct piling condition can be detected to some extent in accordance with the shield of the optical path of the photoelectric device or the non-contact of the inspecting lever with the coins.

SUMMARY OF THE INVENTION

It is therefore an object of the present invention to provide an improved incorrectness detecting device for a coin packing machine, which is so improved that the piled coins are held at its upper side to detect the electric conduction therethrough thereby to enhance the reliability and to simplify the operations.

According to a major feature of the present invention, there is provided an incorrectness detecting device for detecting the coin piling condition in a piling cylinder, said detecting device comprising: a sensor made coactive with a coin kind selecting dial for having its height varied in accordance with the height corresponding to a preset number of coins piled; a detecting element adapted to be brought downwardly into contact with the upper side of the uppermost one of the piled coins, when the preset number of coins are piled in said piling cylinder, for making an electric circuit through the piled coins; and a sensor element made coactive with said detecting element and corresponding to said sensor, whereby the coin piling condition is detected in response to both the signal, which is generated by the interaction between said sensor and said sensor element, and the signal which is generated by said electric circuit.

BRIEF DESCRIPTION OF THE DRAWINGS

Other objects and advantages of the present invention will become apparent from the following description taken in conjunction with the accompanying drawings, in which.

DESCRIPTION OF THE PREFERRED EMBODIMENTS

Figure 1:
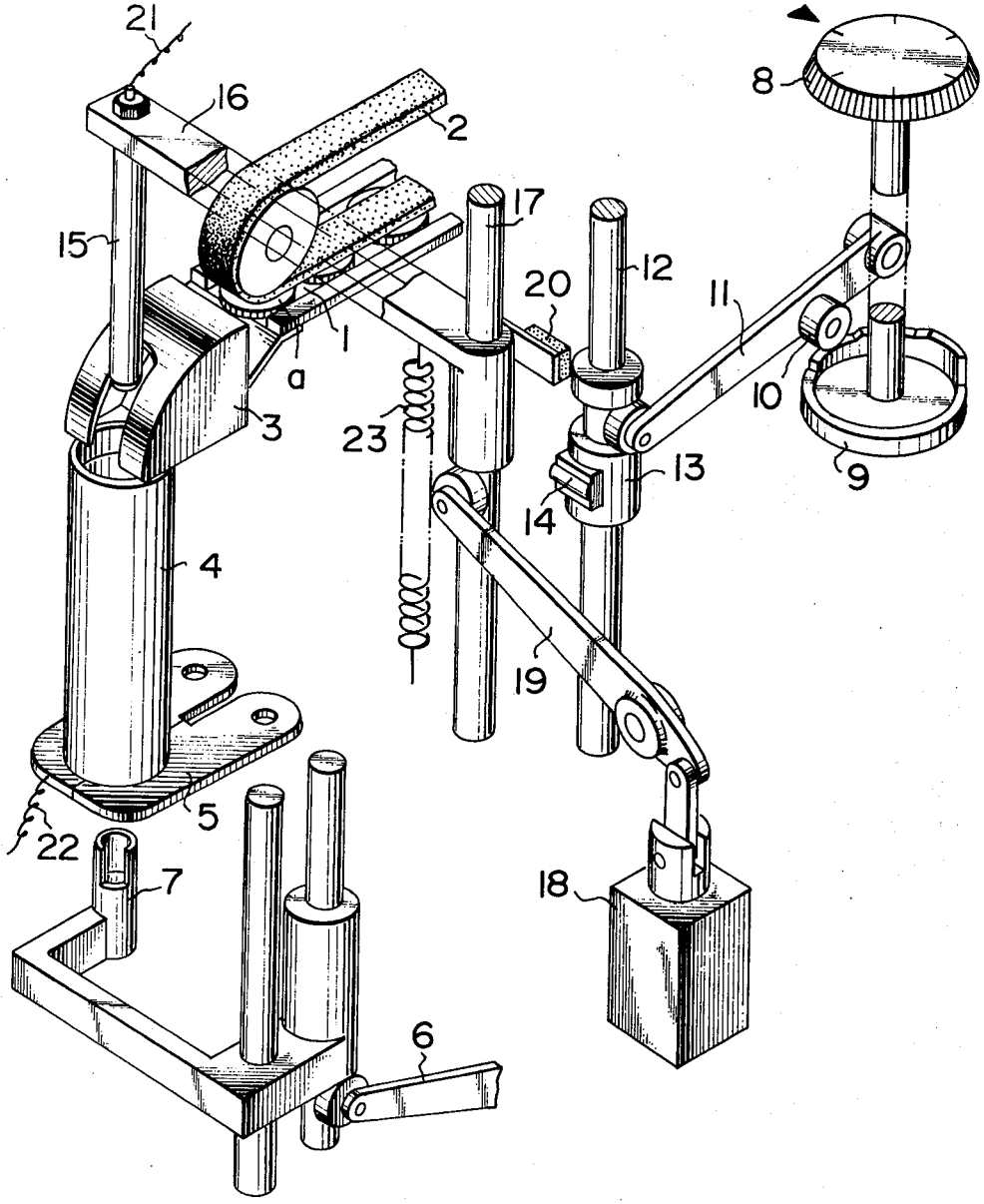
FIG. 1 is an exploded perspective view showing an essential portion of a coin packing machine equipped with the incorrectness detecting device according to the present invention.

In a coin packing machine, as shown in FIG. 1, coins a are conveyed, while being counted, on a coin passage 1 by means of a conveyor belt 2 and are guided by means of a coin guide member 3 so that they may drop into a piling cylinder 4 made of a synthetic resin until they are piled on an openable shutter 5 which provides the lower end cover of the piling cylinder 4.

When a preset number of coins counted are piled in the piling cylinder 4, a support rod 7 is lifted by the rise of a lift lever 6 until it abuts against the lower side of the shutter plate 5. When this plate 5 is then opened, the piled coins in the piling cylinder 4 are supported on the support rod 7 and are moved down, as they are, into the clearance among three packaging rollers, not shown, so that they have their outer circumferences clamped by the packaging rollers. Then, a preset length of packing paper is supplied so that it wraps the piled coins on their outer circumferences, and the coins thus wrapped are discharged to the outer side after the packaging paper is fastened at its both ends.

Figure 2:
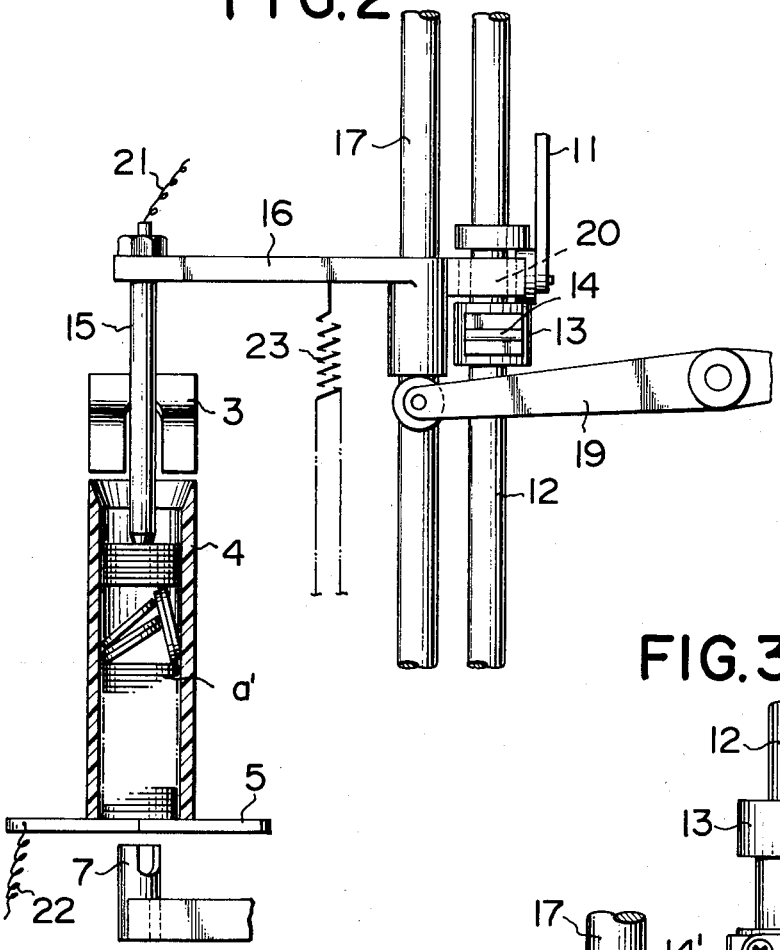
FIG. 2 is a partially cut-away sectional view showing the piling cylinder shown in FIG. 1.

According to the present invention, an actuating lever 11 is operated through a roller 10 by a cam 9 which is made operative in response to the coin kind selecting operation of a coin kind selecting dial 8. A sensor 14, which may be a reed switch shown in FIGS. 1 and 2, is attached to a sliding member 13 which is engaged with the actuating lever 11 and guided by a rod 12.

On the other hand, a detecting element 15 is provided above the piling cylinder 4 so that it may go thereinto. This detecting element 15 is supported by a support lever 16, which in turn is guided to slide up and down along a rod 17 by the action of a cooperating lever 19 which is actuated by a solenoid 18. In a manner to coact with the detecting element 15, there is attached to a portion of the support lever 16 a sensor element 20 such as an induction element made of a magnet, which is positioned to pass over the neighborhood of the sensor 14. Moreover, the detecting element 15 is connected with a lead wire 21, while being insulated from the support lever 16, whereas another lead wire 22 is connected with the shutter 5 while being insulated from other elements.

Figure 3:
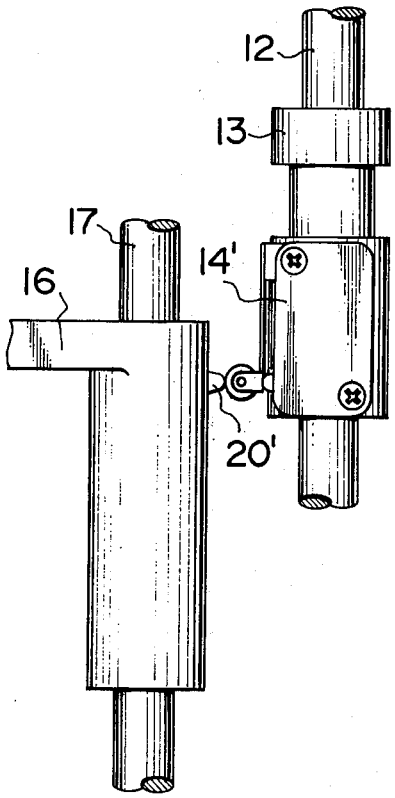
FIG. 3 is a front elevation showing another embodiment.

In another embodiment of the present invention shown in FIG. 3, the aforementioned sensor 14 is composed of a microswitch 14', and the sensor element 20 is composed of a projection 20' which is formed on a portion of the support lever 16.

The operations of the incorrectness detecting device according to the present invention will be described in the following. When the coin kind selecting dial 8 is adjusted in accordance with the kind of the coins to be packaged, the cam 9 is accordingly turned so that the roller 10 is moved up and down in accordance with the cam surface of the cam 9. As a result, the sensor 14 is set at a preset position through the actuating lever 11 and the sliding member 13.

When a preset number of the counted coins a drop into the piling cylinder 4, the solenoid 18 is deenergized so that the cooperating lever 19 loses its rising force of the support lever 16. As a result, the detecting element 15 is made to go downwardly by way of the support lever 16 into the piling cylinder 4 by the action of a coin spring 23 until its leading end abuts against the upper side of the uppermost one of the piled coins. At this instant, an electric circuit is made through the piled coins a' between the lead wires 21 and 22 to generate a signal. In this instance, however, if the piling condition of the coins a' is not incorrect, as shown in FIG. 2, the height of the piled coins a' is accordingly larger that that of the correctly piled coins so that the detecting element 15 is blocked in its course from its downward movement. As a result, although the electric signal indicates conduction between the lead wires 21 and 22, the sensor element 20 fails to approach the sensor 14 so that the sensor 14 is left inoperative and generates no signal. Thus, since there is inconsistency between the signal from the sensor 14 and the signal from the lead wires 21 and 22, neither the support rod 7 is moved up nor the shutter 5 is opened so that the mechanism as a whole is stopped.

In case the coins are piled correctly, the sensor element 20 is aligned with the sensor 14 which has been preset in position so that the sensor 14 is operated to generate its signal. At this time, the lead wires 21 and 22 generate a signal so that the subsequent operations can be accomplished properly in response to the consistency between the signals from the two sources.

In the foregoing embodiments, moreover, the detecting operations can be effected for either case, in which the coins are piled in a more or less number than a preset number. More specifically, the case of the more coins piled is similar to that of the aforementioned piled coins a'. In the case of the less coins piled, no contact is established between the detecting element 15 and the coins even if the signals are generated from the sensor 14 so that the desired purposes can be attained in response to the resultant inconsistency.

As has been described hereinbefore, according to the present invention, the incorrectness detecting device of the present invention can be so highly practical as to detect the piling condition of the coins, while making it possible to accurately confirm the position and to detect any irregular condition of the coins, in accordance with the consistency and inconsistency between the signal indicative of the electric conduction, which is generated by the contact of the detecting element with the upper side of the piled coins, and the signal which is generated by the sensor.

What is claimed is:

1. An incorrectness detecting device for detecting the coin piling condition in a piling cylinder, comprising: a sensor made coactive with a coin kind selecting dial for having its height varied in accordance with the height corresponding to a preset number of coins piled; a detecting element adapted to be brought downwardly into contact with the upper side of the uppermost one of the piled coins, when the preset number of coins are piled in said piling cylinder, for making an electric circuit through the piled coins; and a sensor element made coactive with said detecting element and corresponding to said sensor, whereby the coin piling condition is detected in response to both the signal, which is generated by the interaction between said sensor and said sensor element, and the signal which is generated by said electric circuit.

2. An incorrectness detecting device as set forth in claim 1, wherein said sensor includes a reed switch, and wherein said sensor element includes an induction element made of a magnet.

3. An incorrectness detecting device as set forth in claim 1, wherein said sensor includes a microswitch, and wherein said sensor element includes a projection.

* * * * *